US005174054A

United States Patent [19]

Politi

[11] Patent Number: 5,174,054

[45] Date of Patent: Dec. 29, 1992

[54] PICTURE FRAME

[76] Inventor: Margaret M. Politi, 5927 Kauffman, Temple City, Calif. 91780

[21] Appl. No.: 666,185

[22] Filed: Mar. 7, 1991

[51] Int. Cl.[5] ..... A47G 1/06; G09F 1/12

[52] U.S. Cl. ..... 40/152; 40/152.1

[58] Field of Search ..... 40/152, 152.1, 156, 40/154

[56] References Cited

U.S. PATENT DOCUMENTS

| | | | |
|---|---|---|---|
| Re. 30.476 | 1/1981 | Jennen et al. | 40/152 |
| 83,797 | 11/1868 | Schmitt | 40/154 |
| 737,124 | 8/1903 | Manor | 40/154 |
| 2,186,643 | 1/1940 | Kaplan | 40/154 |
| 2,697,889 | 12/1954 | Heim | 40/152 |
| 2,823,478 | 2/1958 | / stergaard et al. | 40/156 |
| 2,871,600 | 2/1959 | Woodruff | 40/152 |
| 3,988,846 | 11/1976 | Kuhling | 40/156 |
| 4,062,140 | 12/1977 | Meyer et al. | 40/152 |
| 4,104,818 | 8/1978 | Hrabik | 40/152 |
| 4,848,014 | 7/1989 | Yesbick | 40/152 |
| 4,939,858 | 7/1990 | Dailey | 40/152.1 |
| 4,949,483 | 8/1990 | Dobson et al. | 40/152 |

*Primary Examiner*—Kenneth J. Dorner
*Assistant Examiner*—Cassandra Hope
*Attorney, Agent, or Firm*—Boniard I. Brown

[57] ABSTRACT

A picture frame has a front display member including a flat viewing window and an outwardly bulged channel forming a border for the window. A backing panel is positioned behind the display member to hold behind the viewing window a picture and various loose items, e.g., a medal, rolled-up document, flower, etc., within the border channel. Resilient detent mechanisms are molded into the front display member releasably to hold the backing member in position.

8 Claims, 2 Drawing Sheets

PICTURE FRAME

BACKGROUND OF THE INVENTION

The present invention relates to a picture frame, and more particularly to a picture frame having a central space for containment of a picture, and a hollow space defined about the central space for containment of flowers, medals, tassles or other three-dimensional items having an associative relation to the persons or scenes depicted in the picture. The picture frame includes a backing panel having two sets of hinge lugs on its rear face. A swingable strut has an end portion thereof hingedly connectable to either set of hinge lugs, whereby the picture frame is supportable on a shelf or table surface with either its longer edge or its shorter edge extending horizontally. This feature enhances the usefulness or versatility of the picture frame for displaying a variety of different pictures in different orientations.

U.S. Pat. No. 83,797 of I. T. Schmitt (1868) discloses a picture frame formed by placing a glass sheet on a cast iron mold, and heating the mold and glass sheet so that the glass softens so that it gravitationally sinks down into cavities in the mold surface. A continuous hollow shell or channel is formed about the edge of the glass sheet; flowers, pictures or other ornaments may be placed within the channel to enhance the appearance of the picture frame. The Schmitt patent shows a flat panel behind the molded glass sheet. Apparently, the picture to be displayed is placed between the flat panel and the glass sheet. Schmitt does not indicate how the flat panel is connected to the molded glass sheet, or how access is obtained to the space between the panel and glass sheet for insertion or removal of the picture and ornaments.

SUMMARY OF THE INVENTION

The present invention comprises a picture frame wherein a front display member is detachably connected to a rear backing member so that the two members can be separated for placement of a picture and associated items in the space between the two members. The front display member includes a flat transparent viewing window and an endless peripheral channel extending therearound. The channel faces rearwardly to form an annular chamber. The backing member comprises a flat panel adapted to engage rear edge areas of the endless channel, thus to space the backing member a predetermined distance behind the flat transparent viewing window.

The space between the viewing window and backing panel is adapted to receive a picture. The space defined by the channel is adapted to receive ornaments or memorabilia having an associative relation to the picture—e.g., a medal awarded to the person depicted in the picture.

The endless channel includes an inner flange having a rear edge which abuts the backing panel so that the flat central viewing window has a uniform spacing from the backing panel; a picture inserted into the frame will remain in a flat condition without curling or wrinkling.

The endless channel also comprises an outer peripheral flange that includes a peripheral skirt adapted to extend rearwardly beyond the plane of the backing panel. A concealed space is defined behind the backing panel for containment of a hinged support strut. The support strut has alternate detachable connections with two sets of hinge lugs projecting from the rear face of the backing panel, whereby the picture frame can have a "tripod-like" support on a shelf, table or fireplace mantel, with the longer edge of the frame extending either horizontally or vertically, depending on which set of hinge lugs is connected to the support strut.

DESCRIPTION OF A PREFERRED EMBODIMENT OF THE INVENTION

Figure 1:
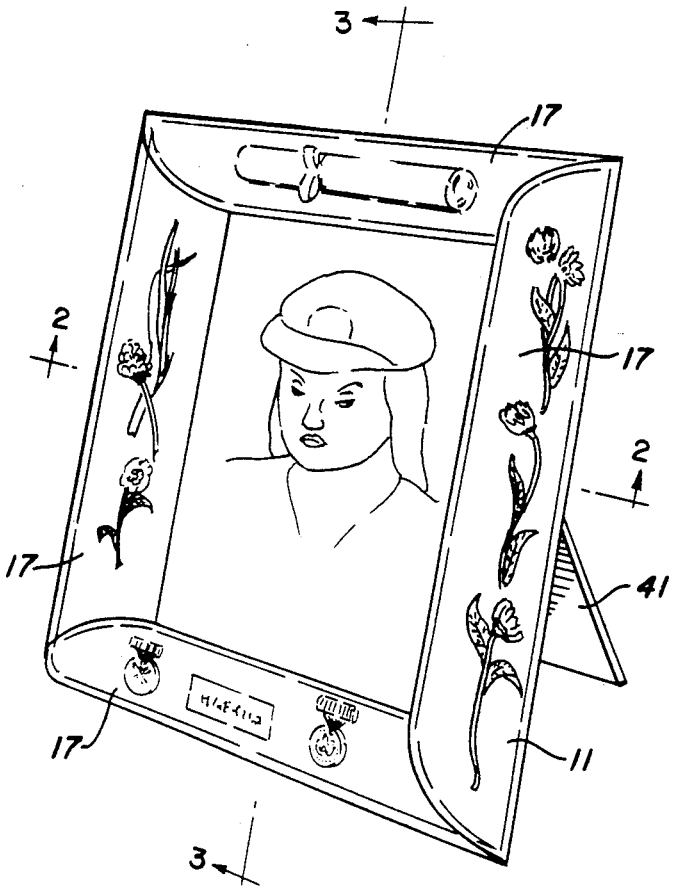
FIG. 1 is a frontal perspective view of a picture frame embodying the present invention.
Figure 2:
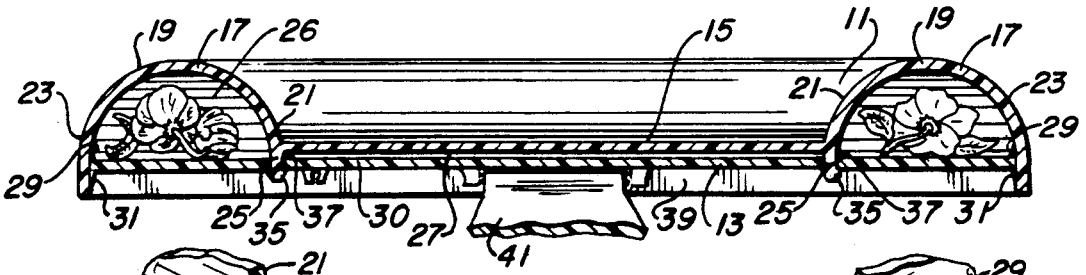
FIG. 2 is a sectional view taken on line 2—2 in FIG. 1.

FIGS. 1 and 2 show an embodiment of the invention wherein a picture frame comprises a front display member 11 and a rear backing member 13. Front member 11 is a one piece transparent plastic structure molded to provide a flat transparent viewing window 15 and a rearwardly-facing transparent peripheral channel 17 contiguous with the peripheral edge of flat window 15.

As seen in FIG. 2, channel 17 has a curved generally semi-circular cross-section that includes a curved web portion 19, an inner peripheral flange 21, and outer peripheral flange 23. The channel extends entirely about window 15—i.e., along all four edges of the window. The channel cross-section is uniform along the four edges of window 15.

Inner flange 21 of the channel has a rear edge 25 that abuts rear backing member 13 at, behind, or beyond flat window 15. The window is thus spaced forwardly of member 13 to provide an enclosed rectangular space 27 for containment of a picture (not shown). Window 15 and backing member 13 extend in parallel relation, whereby the picture is confined to an essentially flat condition in which it is prevented from curling or wrinkling.

Figure 2A:
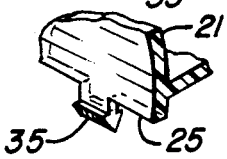
FIGS. 2A and 2B are fragmentary views of structural details which may be utilized in the FIG. 2 picture frame.
Figure 2B:
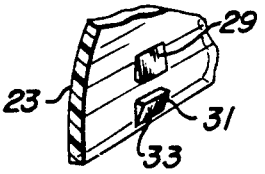
Figure 4A:
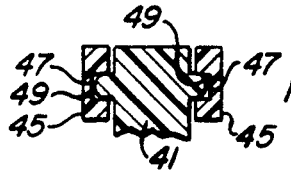
FIG. 4A is a fragmentary sectional view of structural detail that can be utilized in the FIG. 4 picture frame.

As shown in FIGS. 2 and 2B, lugs 29 may be formed on the inner surface of channel outer flange 23. FIG. 2B shows a single lug 29. However, two such lugs may be formed on each of the four outer flanges 23. Each lug forms a rearwardly facing shoulder. Backing member 13 consists of a flat plastic panel 30 adapted to fit within the space circumscribed by the outer peripheral flanges 23 of the endless channel, as shown in FIG. 2. The front face of panel 30 abuts the shoulders formed by lugs 29, and also abuts the rear edges 25 of the channel inner flanges 21.

Panel 30 is held against the channel flanges by deformable detents 31 carried on channel flanges 23. There may be eight such detents, two on each of the four channel flanges 23. Each detent has a cam surface 33 engageable against an edge of panel 30 when the panel is moved forwardly toward front member 11 to the FIG. 2 position. The panel edges snap into the spaces formed between lugs 29 and detents 31, whereby the panel is releasably held against member 11. However, panel 30 can be pried rearwardly away from front member 11 when it becomes necessary to insert a picture into display space 27, or when it becomes necessary to insert a three-dimensional item of memorabilia into the space 26 defined by channel 17.

Panel 30 may also be held against display member 11 by means of spring fingers 35 which extend rearwardly from channel flanges 21. FIG. 2A shows one of the spring fingers, one of which may be formed on each of the four channel flanges 21. Mating rectangular openings 37 are defined in panel 30 so that when the panel is moved forwardly into the space circumscribed by channel outer flanges 23, the hooked ends of the spring fingers will extend through openings 37 to exert retention forces on the rear face of the panel.

Outer peripheral flanges 23 extend rearwardly beyond the rear edges of inner flanges 21 so that when panel 30 is engaged with the channel structure, a concealed space 39 is formed behind the panel. The rear portions of outer flanges 23 form a peripheral skirt that conceals the edges of panel 30 from view when the picture frame is hung on a wall. The concealed space 39 serves as a housing for a swingable strut 41 which may be used to support the picture frame on a shelf, fireplace mantel or table surface. FIG. 1 shows the strut swung away from the picture frame to provide the desired tripod support function.

Figure 3:
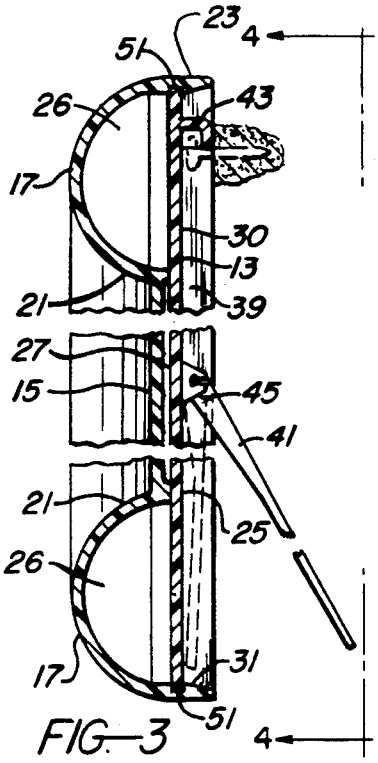
FIG. 3 is a sectional view taken on line 3—3 in FIG. 1, showing a variant form of panel holding means.

When the picture frame is to be hung on a room wall, a rearwardly projecting ledge structure 43 (FIGS. 3 and 4) may be used as a suspension device. A nail 45 may be driven into the room wall to underlie the ledge structure, as shown in FIG. 3. Preferably, there are two ledge structures 43 disposed at right angles to each other, whereby the picture frame can have its shorter side edge extending horizontally or its longer side edge extending horizontally.

Strut 41 is swingably connected to backing panel 30 by alternate sets of hinge lugs 45 formed as integral extensions of the panel. Each set of lugs comprises two spaced parallel lugs having circular pockets 47 in their facing surfaces. Strut 41 has oppositely directed spherical projections 49 adapted to be releasably snap-fitted within the circular pockets, whereby swivelable hinge connections are formed between the strut and panel 30. Two sets of hinge lugs 45 are formed or otherwise attached to panel 30 so that the picture frame can have either its short side edge or its long side edge oriented horizontally.

Figure 4:
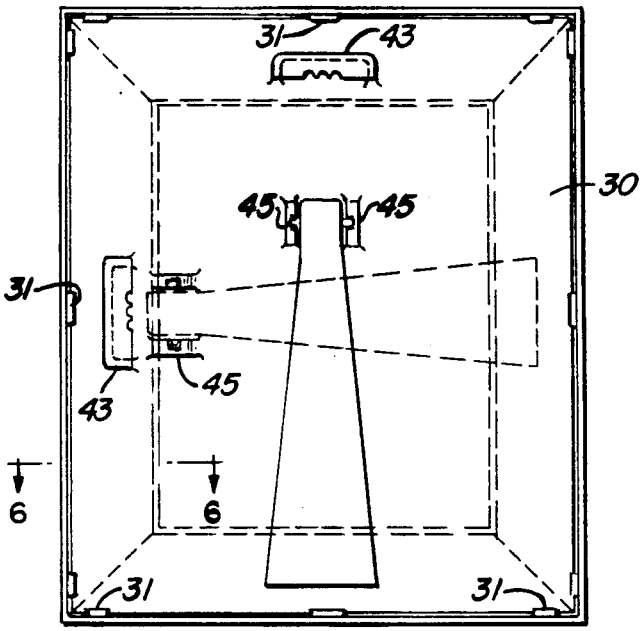
FIG. 4 is a rear view of the FIG. 3 picture frame, taken on line 4—4 in FIG. 3.

FIGS. 3 through 6 show a variant of the panel holding means of FIGS. 2, 2A and 2B. In the arrangement of FIGS. 3 and 4, outer channel flange 23 has a continuous rearwardly facing shoulder 51 extending therealong, as an alternate to the spaced shoulders provided by lugs 29 in FIG. 2B. Panel 30 has its outer edge area seatable against shoulder 51. Deformable detents 31 on flange 23 releasably retain panel 30 in position behind display member 11.

In the arrangement depicted in FIGS. 3 through 6, panel 30 is held in position solely by detents 31. There are no spring fingers of the type shown at 35 in FIGS. 2 and 2A. Thus, the backing panel can be removed from display member 11 with a lesser prying force. However, the assembly is somewhat less rigid, so that a heavier gage plastic might be required for members 11 and 13. When multiple types of fasteners are used, as in FIG. 2, the material used for members 11 and 13 may be relatively light gage, while still achieving satisfactory rigidity.

Figure 7:
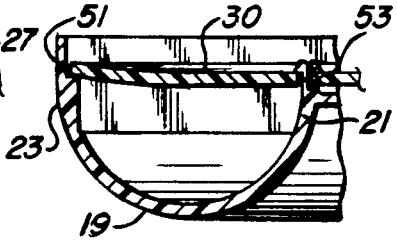
FIG. 7 is a view like that of FIG. 6, but illustrating an alternate panel-holding means that may be utilized in practicing the invention.

FIG. 7 fragmentarily shows a variation wherein panel 30 is held against front member 11 solely by spring fingers 53 extending rearwardly from inner flange 21. Fingers 53 are essentially identical to the spring fingers of FIG. 2A, except that they are bifurcated to increase their resiliency.

Figure 8:
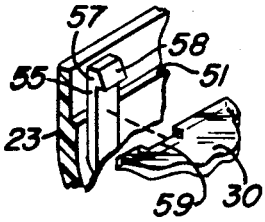
FIG. 8 is a fragmentary perspective view showing another panel-holding means which can be utilized.

FIG. 8 shows a variation of the panel-holding means which takes the form of spring fingers 55 molded integrally with the channel outer flange 23. Preferably, eight such fingers would be utilized, two along each of the four edges of the picture frame. Each finger 55 has a hooked free end 57 which has a cam surface 58. The backing panel has notches 59 in its peripheral edge. When the panel is moved forwardly into the space circumscribed by peripheral flange 23, spring fingers 55 are cammed outwardly, and then allowed to snap back onto the panel rear face to retain the panel in contact with display member 11.

There are shown in the drawings various ways of releasably retaining a backing panel 30 in position behind a front display member 11. The display member includes a flat transparent viewing window 15 that can hold a picture flat against the backing panel. Rear edge 25 of channel flange 21 is in firm engagement with panel 30 to assist in providing a rigid three-dimensional picture frame. Outer flange 23 provides a peripheral skirt for concealing the edge of panel 30, and also for defining a concealed space 39 which may be used to contain a support strut 41. Member 11 may be molded so that the rear edges of channel flanges 23 are in the same imaginary plane, whereby when the picture frame is hung on a room wall, the outer peripheral edge of the frame will seat evenly on the room wall surface without any large cracks or spaces between the frame and wall surface. The circular cross-sectional curvature of channel 17 is such that an ornamental three-dimensional effect is achieved. The flower, medal, souvenir or other three-dimensional item of memorabilia displayed within channel 17 is viewable in its three-dimensional proportions from various different points in a room.

Figure 5:
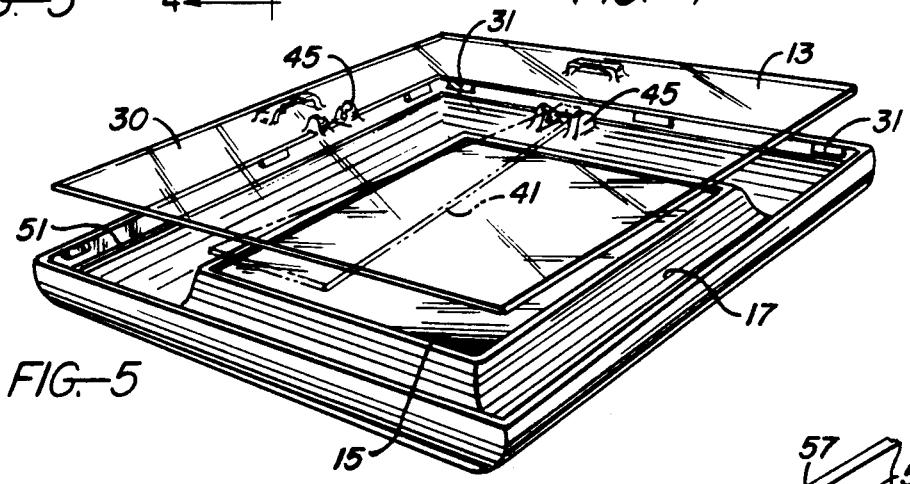
FIG. 5 is a rear perspective view of the picture frame of FIGS. 3 and 4.
Figure 6:
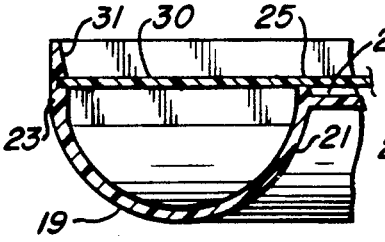
FIG. 6 is a fragmentary view of a portion of the structure shown in FIG. 3.

When inserting a picture or item of memorabilia into the picture frame, the preferred procedure is to completely remove backing panel 30, and to orient the display member 11 in an inverted position (as in FIG. 5). The items may be readily placed within channel 17 or on window 15, after which the backing panel 30 may be pressed downwardly into a position where the detents or spring fingers snap into retentive engagement with the panel.

Thus there has been shown and described a novel picture frame which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A picture frame comprising:

a front display member comprising a flat transparent viewing window having a peripheral edge, and a rearwardly-facing transparent channel extending about the window in contiguous relation to said window peripheral edge, said transparent channel projecting forwardly from the plane of said window to form a memorabilia display space located at least partially in front of the window plane, said transparent channel comprising an inner flange joined to the peripheral edge of the window and an outer flange spaced from said peripheral edge, said inner flange spanning the window plane to form a rear edge spaced behind the window plane, said outer flange defining the outer edge of the picture frame, a rear backing member comprising a flat panel adapted to fit within a space circumscribed by the outer peripheral flange of the transparent channel, said flat panel having a front face abutting the rear edge of said inner flange to form a picture-containment space between the window and the panel, said outer flange of the transparent channel having rearwardly-facing shoulder means adapted to engage said flat panel, said outer peripheral flange extending rearwardly beyond said shoulder means to form a skirt wall spanning the plane of the flat panel, and means for detachably holding the backing panel against said channel inner flange and said rearwardly-facing shoulder means.

2. The picture frame of claim 1, wherein:

said panel holding means comprises a plurality of deformable detents carried on said outer flange in opposed spaced relation to the rearwardly-facing shoulder means normally to prevent movement of the flat panel away from said shoulder means.

3. The picture frame of claim 2, wherein:

each deformable detent has a cam surface engageable with edge portion of the flat panel while the panel is being moved toward said shoulder means.

4. The picture frame of claim 1, wherein:

said panel holding means comprises a plurality of openings in said flat panel, and a plurality of spring fingers extending rearwardly from the rear edge of said inner flange, whereby forward movement of the flat panel enables the spring fingers to project through said openings to grip the panel.

5. The picture frame of claim 4, wherein said spring fingers are integral with the inner flange.

6. The picture frame of claim 1, and further comprising:

a support strut hingedly connected with said flat panel for movement between a retracted position against the panel and a frame-support position extending away from the panel, said skirt wall having a rear edge located in a plane extending behind the support strut when it is in its retracted position.

7. The picture frame of claim 1, wherein:

said flat panel has a number of notches in its peripheral edge, said panel holding means comprises a plurality of resilient spring fingers extending from the outer flange of said channel through the notches in the panel, said spring fingers having hooked ends adapted to engage the panel to retain the panel in contact with said rearwardly-facing shoulder means.

8. The picture frame of claim 1, wherein:

said transparent channel has a semi-circular cross section.

* * * * *